United States Patent [19]

Lanuzzi et al.

[11] Patent Number: 4,761,033

[45] Date of Patent: Aug. 2, 1988

[54] CHAIR

[75] Inventors: Max Lanuzzi, Ponte Capriasca; Fredi Dubach, Baretswil, both of Switzerland

[73] Assignee: Drabert Sohne GmbH & Co., Minden, Fed. Rep. of Germany

[21] Appl. No.: 52,436

[22] Filed: May 20, 1987

[30] Foreign Application Priority Data

May 26, 1986 [DE] Fed. Rep. of Germany ..... 3617624

[51] Int. Cl.[4] ..... A47C 1/024

[52] U.S. Cl. ..... 297/316; 297/301; 297/320; 297/353

[58] Field of Search ..... 297/319, 320, 316, 313, 297/83, 84, 68, 285, 353, 301; 248/424

[56] References Cited

U.S. PATENT DOCUMENTS 2,859,799 11/1958 Moore ..... 297/316 X
4,640,548 2/1987 Desanta ..... 297/320
4,709,962 12/1987 Steinmann ..... 297/316

FOREIGN PATENT DOCUMENTS 0164266 12/1985 European Pat. Off. ..... 297/316
2843058 3/1980 Fed. Rep. of Germany ..... 297/316

*Primary Examiner*—James T. McCall

[57] ABSTRACT

A chair with a seat support (7) has a seat plate (11) which is supported to the seat support (7) by means of a rear and a front guide rod. The chair has a back rest support (14*a*) that is pivot-hinged to the seat support (7). The seat support (7) is connected to a rigid, back rest angle support (1) by means of a front and a back parallelogram guide rod (3). The angle support is fixed to the bottom part of the chair (2). The parallelogram guide joints (3) are also connected to each other by means of a parallel guide rod (4). A first force storage member (5) is situated between the seat support (7) and the back rest angle support (1) and a second force storage member (15) is located between the back rest support (14*a*) and the seat support (7). The force necessary for the slope of the back rest is independent of the weight of the user. A user with higher weight must expend a higher amount of force for the slope of the back rest to move backward than a user with a lower weight.

8 Claims, 3 Drawing Sheets

CHAIR

BACKGROUND OF THE INVENTION

The present invention relates to a chair with seat support having a seat plate secured by means of a rear guide rod to the seat support as well as to a back rest support which is pivot-hinged at the seat support.

Such chairs are known in various designs, among them one is described in DE-PS No. 28 22 574.

For all such known chairs, the setting force for the back rest angle must be adjusted by the user. This involves an additional adjustment step along with the other adjustment steps to be conducted by the user such as height adjustment. In practice, many adjustment possibilities lead to the fact that they are often not performed or that even wrong settings are chosen.

SUMMARY OF THE INVENTION

It is the object of the present invention to provide for a chair of the above type which is designed in such a way that a setting of the back rest support force is not required and, as a result, the back rest setting force increases with increasing user weight.

This object is achieved in the present invention chair structure by connecting the seat plate to the seat support by means of a front guide rod and by connecting the seat support to a rigid back rest angle support by means of a front and a rear parallelogram guide rod. The back rest angle support is fixed to the lower portion of the seat whereby the parallelogram guide rods are connected by joints, by means also of a parallel guide rod and a first force storage element takes effect between the seat support and the back rest angle support and a second force storage element is effective between the back rest support and the seat support. Both force storage members are considerably pre-stressed in accordance with the weight of the user. As a result the movement of the back rest occurs relatively easily with the concomitantly engaged synchronous motion of the seat.

The preferred embodiment of the invention is explained in more detail below, with reference being made to accompanying drawings in which:

DESCRIPTION OF THE PREFERRED EMBODIMENT

Figure 1:
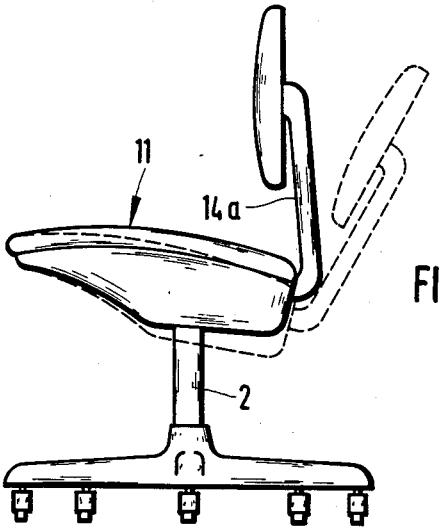
FIG. 1 shows a schematic lateral view of a chair.

In FIG. 1, the chair is depicted in two extreme angled positions of the back rest. Shown in straight lines in the forward final setting of the back rest, and in dashes the backward final setting of the rest. By applying pressure to the back rest the effect is that the seat 11 is moved synchronously with the back rest motion. The magnitude of the reverse force for this motion is automatically adjusted by the adjustment mechanism that is described in more detail below, in accordance with the weight of the user's body.

Figure 2:
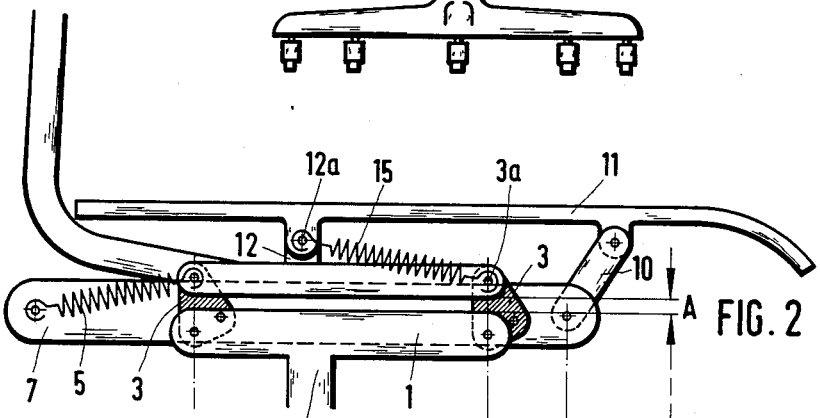
FIG. 2 shows a schematic lateral view of the seat section in a first position without weight put on it by a user.
Figure 3:
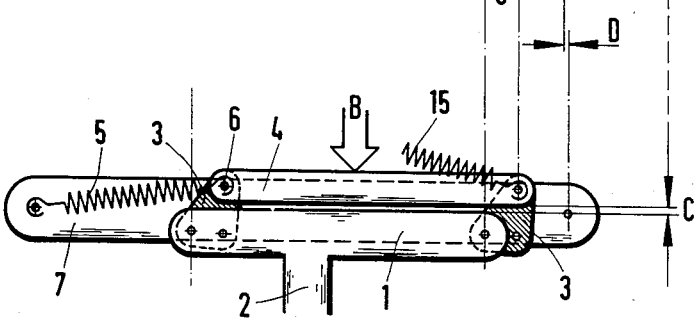
FIG. 3 shows a lateral view indicating only a part of the section shown in FIG. 2 when weight is put on the chair by the user.
Figure 4:
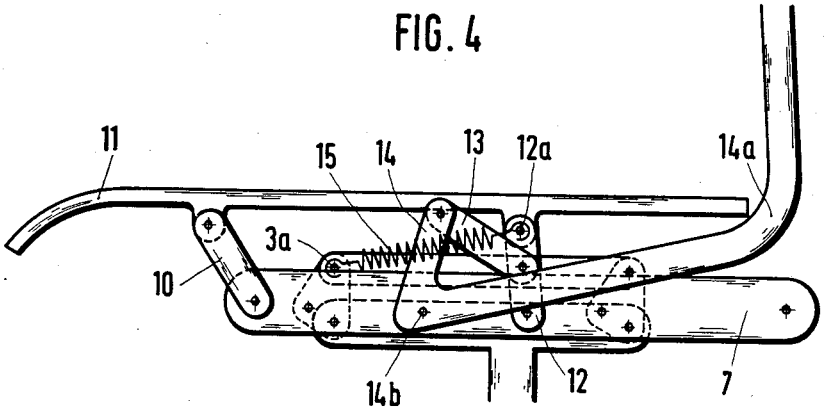
FIG. 4 shows a lateral view of the chair with the back rest moved forward.
Figure 5:
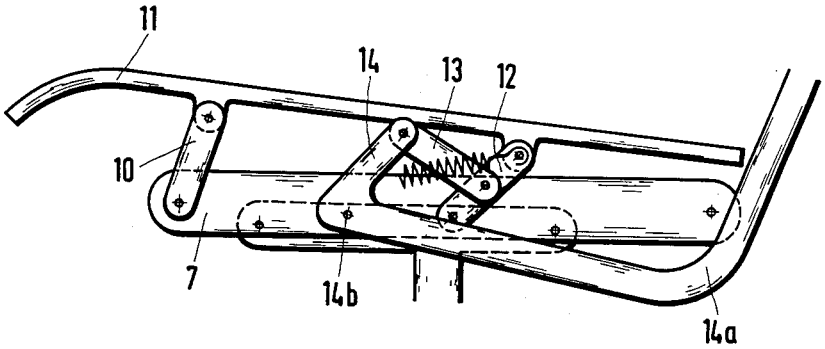
FIG. 5 shows a lateral view of the chair in FIG. 4 with the back rest moved backward.

In FIGS. 2 and 3, parallelogram guide rods 3 are hinged to a slope support 1, which is in turn connected to the lower portion of the chair 2. The ends of the guide rods are connected by means of a parallel guide rod 4. The parallelogram guide rods 3 are also hinged to a seat support 7. A first force storage element 5, which is designed as a tensioned spring in all embodiments, is secured, on the one hand, to the seat support 7, and, on the other hand, to the pressure point 6. The parallelogram guide rod 3 and parallel guide rod 4 are joined together at the pressure point 6.

A second force storage element 15 is formed as a pressurized spring for the embodiments shown in FIGS. 2 to 5 and is hinged, at one point, at the joint **3*a*, and at another point at hinge 12*a*. The hinge point 12*a* is the pressure point of the rear guide rod 12 at the seat 11. The rear guide rod 12 is hinged at the seat support 7** with its other end.

The seat 11 is also secured to the seat support 7 by means of the guide rod.

Furthermore, the back rest support **14*a*, is hinged at the seat support 7, at the joint point 14*b*, where it is movable. The front, bent section 14, of the back rest support is connected to a guide rod 13. The rod 13, is in turn hinged about in the middle of the rear guide rod 12**.

Figure 6:
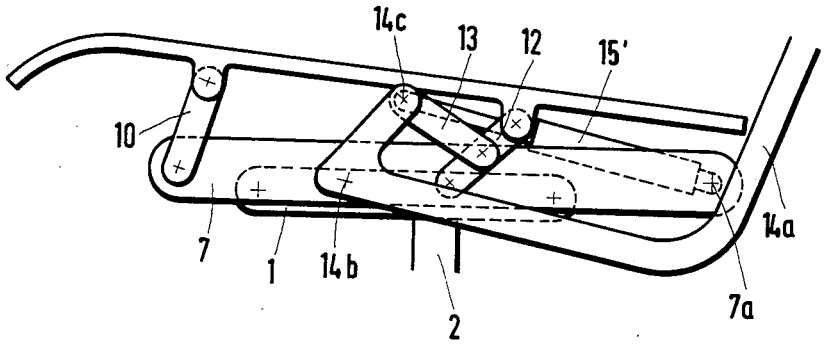
FIG. 6 shows a lateral view of a second embodiment which is similar to FIG. 5.
Figure 7:
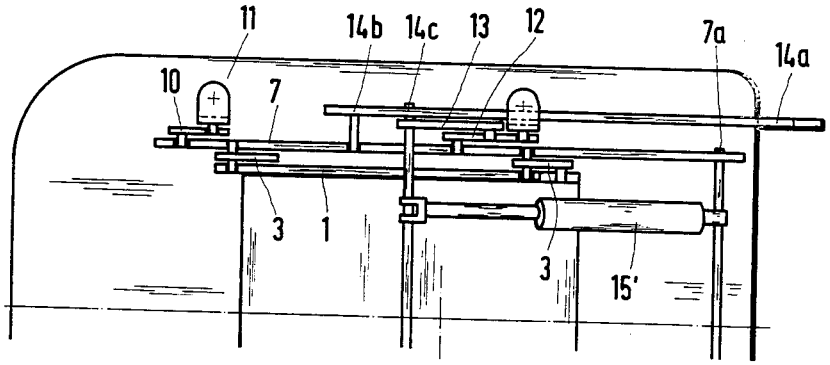
FIG. 7 shows a view from the bottom in accordance with the embodiment of FIG. 6.

The embodiment depicted in FIGS. 6 and 7 differs from the embodiments shown in FIGS. 2 to 5 only by the different design and configuration of the second force storage element 15. In this embodiment the second force storage element 15 is hinged at the joint point **7*a* of the seat support 7 for the embodiment at joint point 14*c* and, on the other hand, at joint point 7*a* of the seat support 7**.

Referring to FIG. 2 and FIG. 3, the operation of the adjustment mechanism is clearly visible. The parallelogram guide rod 3 moves to the right against the force of the pressurized spring 5 when pressure is applied in accordance with arrow B (see FIG. 3). As a result, the clearance between the parallelogram guide rod 4 and the back rest angle support 1 reduces from value A (FIG. 2) to value C. The seat support 7 is moved forward by the shift motion of the parallelogram guide rod 3 in accordance with the weight of the user.

The previously described mechanism not only serves to provide a spring action to the seat as a function of the weight of the user, but also to provide the weight-dependent setting and synchronous movement of the back rest angle adjustment mechanism.

When the chair is used, the first force storage element 5 is considerably pre-tensioned in accordance with the weight of the user. Simultaneously, the second force storage element 15 is also considerably pre-tensioned in accordance with the weight of the user by the parallel shifting, so that the motion of the back rest moves relatively easily with the interrelated synchronous motion of the seat.

The back rest support **14*a*, which is mounted at the seat support 7 at point 14*b*, moves the guide rod lever 13 across a specific area 14. The guide rod 13 moves the seat by means of the guide rod 12 in such a way that the seat is lowered more in the back than in the front from its normal position in connection with the front guide rod 10** and thereby, the back rest in turn moves toward the back.

When weight is removed from the chair, the chair resumes its original position settings.

I claim:

1. A chair comprising:

a seat support (7);

a back rest support (14*a*) which is pivot-hinged to said seat support (7);

a seat plate (11) connected to said seat support (7) by means of a rear and a front guide rod (10,12);

a stationary back rest angle support (1) connected to said seat support (7) by means of a front and a rear parallelogram guide rod (3), said parallelogram guide rods (3) being connected with joints to each other by means of a parallel guide rod (4) extending therebetween;

a first force storage member (5) arranged to act between said seat support (7) and said back rest angle support (1); and, a second force storage member (15) arranged to act between said back rest support (14*a*) and said seat support (7).

2. A chair in accordance with claim 1 wherein said first force storage member (5) is hinged both at said seat support (7) and at a joint point (6) of said parallel guide rod and the parallelogram guide rod (3).

3. A chair in accordance with claim 2 wherein said second force storage member (15) is hinged at a pressure point (12*a*) of the guide rod (12) at the seat and at a joint point (3*a*) of said parallel guide rod (4) and the parallelogram guide rod (3).

4. A chair in accordance with claim 3 wherein said second force storage member (15) is hinged both at the seat support (7) and at the back rest support (14*a*).

5. A chair in accordance with claim 4 wherein said back rest support (14*a*) includes a section extending across its pressure point (14*b*) at the seat support (7) having free end connected to a guide rod (13), said rod being hinged to the rear guide rod (12) connecting said seat support (7) to said seat (11).

6. A chair in accordance with claim 5 wherein said parallelogram guide rods (3) are triangular-shaped with one joint point located in each corner.

7. A chair according to claim 6 wherein said force storage members (5, 15) are springs.

8. A chair in accordance with claim 6 wherein at least one force storage member (15) is a gas-filled spring.

* * * * *